US005127327A

United States Patent [19]

Philpot

[11] Patent Number: 5,127,327

[45] **Date of Patent: * Jul. 7, 1992**

[54] SPECIALLY CONFIGURED PRINTING PLATE COMPOSITE AND SECUREMENT APPARATUS

[75] Inventor: Ivan N. Philpot, Irving, Tex.

[73] Assignee: Matthews International Inc., Pittsburgh, Pa.

[ * ] Notice: The portion of the term of this patent subsequent to Feb. 11, 2009 has been disclaimed.

[21] Appl. No.: 675,743

[22] Filed: Mar. 27, 1991

[51] Int. Cl.[5] ..... B41F 1/28

[52] U.S. Cl. ..... 101/415.1; 101/378

[58] Field of Search ..... 101/375, 378, 382.1, 101/383-389, 415.1, 485, 486, DIG. 36

[56] References Cited

U.S. PATENT DOCUMENTS

| | | | |
|---|---|---|---|
| 3,213,790 | 10/1965 | McKay | 101/376 |
| 3,228,329 | 1/1966 | Mangus et al. | 101/378 |
| 3,295,443 | 1/1967 | Devon | 101/376 |
| 3,489,085 | 1/1970 | Kirkpatrick | 101/415.1 |
| 3,675,573 | 7/1972 | Hawks | 101/378 |
| 3,745,921 | 7/1973 | MacDonald et al. | 101/378 |
| 3,934,509 | 1/1976 | Saunders et al. | 101/415.1 |
| 4,932,324 | 6/1990 | Pinkston et al. | 101/415.1 |

OTHER PUBLICATIONS

Rogers Corporation News Release.

"It's Time for a Change in Flexo" Box Board Containers, Dec., 1979.

*Primary Examiner*—Edgar S. Burr

*Assistant Examiner*—Ren Yan

*Attorney, Agent, or Firm*—Armstrong, Nikaido, Marmelstein, Kubovcik & Murray

[57] ABSTRACT

This invention provides a specially configured printing plate composite and securement apparatus for a printing plate. The apparatus includes a first flat strip-like portion, a second flat strip-like portion narrower than the first strip-like portion and a third strip-like portion which is also narrower than the first strip-like portion. A first connecting strip-like portion connects one outer edge of the first strip-like portion to an outer edge of the second strip-like portion and a second connecting strip-like portion connects an axially opposed outer edge of the first strip-like portion to an outer edge of the third strip-like portion thereby forming an S-shaped securement apparatus having a flexible sheet-like roll covering member secured to such first flat strip-like portion. The apparatus also has a fourth and fifth strip-like portion and a third connecting strip-like portion. A generally flexible printing plate carrier sheet member is secured to the fourth strip-like portion which carries a printing plate on an upper surface thereof.

20 Claims, 2 Drawing Sheets

SPECIALLY CONFIGURED PRINTING PLATE COMPOSITE AND SECUREMENT APPARATUS

FIELD OF THE INVENTION

The present invention relates, in general, to equipment used in printing arrangements for securing a printing plate, having predetermined printing indicia disposed on an outer surface thereof, to at least a predetermined portion of a working surface of at least one printing plate cylinder disposed in at least one print station of such printing arrangement and, more particularly, this invention relates to a specially configured printing plate composite and securement apparatus which enables both securing one end of a carrier sheet having such printing plate disposed on an upper surface thereof to such predetermined portion of such working surface of such at least one printing plate cylinder and an achievement of a relatively quick alignment of such printing plate composite in a predetermined position on such working surface of such printing plate cylinder.

CROSS-REFERENCE TO RELATED APPLICATIONS

The invention taught and claimed in this application is closely related to U.S. patent application Ser. No. 07/586,272 entitled, "An Apparatus for Securing a Printing Plate to a Printing Plate Cylinder and a Printing Plate Composite Utilizing Such Apparatus", filed on Sep. 21, 1990 and to U.S. patent application Ser. No. 07/586,273 entitled, "An Improved Printing Plate Composite Including a Quick Mounting System for Securing Such Composite to a Printing Plate Cylinder", filed on Sep. 21, 1990 and to U.S. Ser. No. 07/662,727 entitled, "A Printing Plate Mounting System and a Printing Plate Composite Utilizing Such System", filed on Feb. 28, 1991 and is related to U.S. patent application Ser. No. 07/675,744 filed concurrently herewith and to U.S. patent application Ser. No. 07/675751 also filed concurrently herewith. The disclosure of such closely related U.S. patent applications being incorporated herein by reference thereto.

BACKGROUND OF THE INVENTION

It has, during the recent past, become the generally accepted practice, in the retail sales industry, to utilize what is known in the packaging manufacturing industry as "point of sales" packaging for the majority of products to be offered for sale in a retail outlet. This particular practice, as generally would be expected, has induced the package manufacturing industry to both develop and implement new equipment and operating procedures. Such new equipment and operating procedures being necessary so that significant improvement in the quality of printing could be economically achieved. In other words, the former "brown box" would no longer be an acceptable package for products offered for sale in a retail outlet.

As a result, flexographic printing was introduced into such package printing industry and such flexographic printing equipment is now in widespread use. See, for example, an article published in the December, 1979 issue of Box Board Containers titled "It's Time for a Change in Flexo". As pointed out in this particular article, flexographic printing equipment entered the package printing industry in the 1960's. It was at this time that packaging converters began installing the necessary equipment to initiate use of the flexographic printing process. It is important to note that such packaging converters had the capability of now printing, slotting, folding, gluing, die-cutting and bundling in a true production line manner with this new flexographic equipment.

This change in printing equipment to flexography also offered the potential for extended capabilities and other improvements in package printing. This, in addition, to all the advantages of the in-line operations discussed above. This was not the case, however, because these additional benefits were not immediately taken advantage of by the packaging converters. For example, even with this new flexographic printing equipment and process, the packaging converters continued to use the same old style printing plate systems that they had been using prior to the introduction of the flexo printing system. This outdated printing plate system consisted of a relatively thick rubber plate secured to a fabric-like material which, in turn, was secured to a carrier material.

It is also generally well known, in the prior art, to use a substantially T-shaped member in order to both align and secure one end of a printing plate, carried on a sheet material, to the printing plate cylinder. Such securement of the printing plate occurring substantially parallel to the longitudinal axis of the printing plate cylinder. In this case, the printing plate is disposed on a vinyl-like sheet member which, in turn, is positioned for engagement with the working surface of such printing plate cylinder. The T-shaped member is secured to one end of the vinyl-like sheet and the axially opposed other end of such vinyl-like sheet is secured to the printing plate cylinder with either tape or strap-like members.

This particular fastening system for the printing plate is commonly known in the package printing industry as the Matthews Fast-Loc. This system, which is in widespread use in the packaging industry, results in a significant reduction in down time of the printing press being required in order to achieve proper alignment of the printing plate on the working surface of the printing plate cylinder. In this manner, economy of operation could be achieved by the packaging convertors.

SUMMARY OF THE INVENTION

The present invention provides a specially configured printing plate composite and securement apparatus. This securement apparatus is useful in securing one end of a carrier sheet having at least one printing plate disposed on an upper surface of such carrier sheet to at least a predetermined portion of a working surface of at least one printing plate cylinder. Such printing plate cylinder being disposed in at least one print station of a printing arrangement. Such securement arrangement is also used to achieve a relatively quick alignment of such printing plate composite in a predetermined position on such working surface of the printing plate cylinder. This specially configured printing plate composite and securement apparatus includes a first elongated and substantially flat strip-like portion having each of axially opposed outer edges and axially opposed surfaces. Such first flat strip-like portion further has a first predetermined length, a first predetermined width and a first predetermined thickness. Further, there is a generally flexible and substantially rectangular-shaped sheet-like roll covering member incorporated into the apparatus. This sheet-like roll covering member having axially opposed surfaces and a pair of axially opposed outer edges. Such sheet-like roll covering member also has a predetermined length and a predetermined width and a predetermined thickness. Such predetermined thickness of the sheet-like roll covering member being generally between about twenty-five thousandths of an inch and about thirty-five thousandths of an inch. A relatively narrow portion of an upper surface of such sheet-like roll covering member being engaged with at least a portion of a first surface of such axially opposed surfaces of such first flat strip-like portion adjacent a first outer edge of a first pair of such pair of axially opposed outer edges. This first outer edge of such first pair of such pair of axially opposed outer edges is located along such predetermined width of the sheet-like roll covering member; and, such at least a substantial portion of such first surface of such axially opposed surfaces of the first flat strip-like portion being located along such first predetermined length of such first flat strip-like portion. In addition, such securement apparatus includes a first securing means engageable with such first flat strip-like portion and the sheet-like roll covering member which secures such narrow portion of the sheet-like roll covering member to the substantial portion of such first flat strip-like portion. The securement apparatus also includes a second elongated and substantially flat strip-like portion having each of axially opposed outer edges and axially opposed surfaces. Such second flat strip-like portion further having a second predetermined length, a second predetermined width, which is less than such first predetermined width of the first flat strip-like portion, and a second predetermined thickness. A first surface of such axially opposed surfaces of such second flat strip-like portion is positioned facing a first surface of such axially opposed surfaces of the first flat strip-like portion and a bottom surface of such sheet-like roll covering member. Further, such securement apparatus includes a third elongated and substantially flat strip-like portion having each of axially opposed outer edges and axially opposed surfaces. Such third flat strip-like portion further having a third predetermined length and a third predetermined width, which is also less than such first predetermined width of such first flat strip-like portion, and a third predetermined thickness. A first surface of such axially opposed surfaces of the third flat strip-like portion is positioned such that it faces a second surface of such axially opposed surfaces of the first flat strip-like portion. In addition, the apparatus includes a first elongated connecting strip-like portion having axially opposed outer edges and axially opposed surfaces. This first connecting strip-like portion further having a fourth predetermined length and a fourth predetermined width and a fourth predetermined thickness. A first outer edge of such axially opposed surfaces of such first connecting strip-like portion is connected to a first outer edge of such axially opposed outer edges of such first flat strip-like portion substantially along the first predetermined length of such first strip-like portion and such fourth predetermined length of such first connecting strip-like portion. A second outer edge of such axially opposed outer edges of such first connecting strip-like portion is connected along such fourth predetermined length thereof to a first outer edge of the axially opposed outer edges of the second elongated flat strip-like portion along the second predetermined length thereof. A second outer edge of such axially opposed outer edges of the second flat strip-like portion being engageable in a groove-like portion formed adjacent a working surface of such printing plate cylinder. This groove-like portion being disposed substantially parallel to a longitudinal axis of the printing plate cylinder. Another essential element of the securement apparatus is a second elongated connecting strip-like portion which has axially opposed outer edges and axially opposed surfaces. This second connecting strip-like portion further has a fifth predetermined length and a fifth predetermined width, which is equal to or less than the such fourth predetermined width of the first connecting strip-like portion, and a fifth predetermined thickness. A first outer edge of such axially opposed outer edges of the second connecting strip-like portion is connected to a second outer edge of such axially opposed outer edges of such first flat strip-like portion along such first predetermined length of such first flat strip-like portion and the fifth predetermined length of such second connecting strip-like portion. A second outer edge of such axially opposed outer edges of such second connecting strip-like portion being connected along the fifth predetermined length thereof to a first outer edge of such third flat strip-like portion along the third predetermined length thereof, thereby forming a specially configured S-shaped printing plate securement apparatus having a roll covering member incorporated therewith.

In order to form the printing plate composite there is a fourth elongated and substantially flat strip-like portion provided which has each of axially opposed outer edges and axially opposed surfaces. Such fourth flat strip-like portion further having a sixth predetermined length and a sixth predetermined width and a sixth predetermined thickness. Such printing plate composite also requires a fifth elongated and substantially flat strip-like portion having each of axially opposed outer edges and axially opposed surfaces. This fifth flat strip-like portion further having a seventh predetermined length and a seventh predetermined width, which is less than said sixth predetermined width of said fourth flat strip-like portion, and a seventh predetermined thickness. A first surface of said axially opposed surfaces of said fifth flat strip-like portion is positioned facing a first surface of said axially opposed surfaces of said fourth flat strip-like portion. There is a third elongated connecting strip-like portion having axially opposed outer edges and axially opposed surfaces. Such third connecting strip-like portion further having an eighth predetermined length and an eighth predetermined width and an eighth predetermined thickness. A first outer edge of such axially opposed outer edges of the third elongated connecting strip-like portion is connected to a first outer edge of such axially opposed outer edges of the fourth flat strip-like portion along the sixth predetermined length thereof and such eighth predetermined length of such third connecting strip-like portion. A second outer edge of such axially opposed outer edges of the third connecting strip-like portion is connected to a first outer edge of such axially opposed outer edges of the fifth flat strip-like portion along such seventh predetermined length thereof and the eighth predetermined length of such third connecting strip-like portion thereby forming a J-shaped hook-like member which, during operation, will be engaged with said S-shaped member. Such printing plate composite further requires a generally flexible and generally rectangular-shaped printing plate carrier sheet member having a bottom surface which, during use, faces an upper surface of said sheet-like roll covering member and an upper surface which carries such printing plate thereon and a pair of axially opposed outer edges. This printing plate carrier sheet member further having a predetermined length and a predetermined width and a predetermined thickness, said predetermined thickness of said printing plate carrier sheet member being generally between about twenty-five thousandths of an inch and about thirty-five thousandths of an inch. A narrow portion of at least one of the upper surface and the bottom surface of such printing plate carrier sheet member being engaged with at least a substantial portion of one of such axially opposed surfaces of the fourth flat strip-like portion adjacent a first outer edge of a first of such pair of axially opposed outer edges of the printing plate carrier sheet member. Such first outer edge of the first of such pair of axially opposed outer edges of the printing plate carrier sheet member being located along the predetermined width of such printing plate carrier sheet member and such at least a substantial portion of such one of the axially opposed surfaces of such fourth flat strip-like portion being located along the sixth predetermined length of such fourth flat strip-like portion. The final essential element of the printing plate carrier composite and securement apparatus is a second securing means engageable with such fourth flat strip-like portion and such printing plate carrier sheet member for securing such printing plate carrier sheet member to the fourth flat strip-like portion.

In a second aspect of the present invention, there is provided a specially configured printing plate composite which can be both quickly secured to and accurately aligned on a predetermined portion of a working surface of a printing plate cylinder disposed in at least one print station of a printing arrangement. This printing plate composite is configured for a single customer use. This specially configured printing plate composite includes a first elongated and substantially flat strip-like portion having each of axially opposed outer edges and axially opposed surfaces. This first flat strip-like portion further having a first predetermined length and a first predetermined width and a first predetermined thickness. The composite has a generally flexible and generally rectangular-shaped printing plate carrier sheet member having a bottom surface and an upper surface which carries such printing plate thereon, and a pair of axially opposed outer edges. Such printing plate carrier sheet member further having a predetermined length and a predetermined width and a predetermined thickness of generally between about twenty-five thousandths of an inch and about thirty-five thousandths of an inch. A narrow portion of at least one of such bottom surface and such top surface of the printing plate carrier sheet member being engaged with at least a substantial portion of one of an upper surface and a bottom surface, respectively, of such axially opposed surfaces of the first flat sheet-like portion adjacent a first outer edge of a first of such pair of axially opposed outer edges of the printing plate carrier sheet member. This first outer edge of such first of the pair of axially opposed outer edges of the printing plate carrier sheet member being located along the predetermined width of such printing plate carrier sheet member and such at least a substantial portion of such one of the upper surface and bottom surfaces of such axially opposed surfaces of the first flat strip-like portion being located along such first predetermined length of such first flat strip-like portion. There is a generally flexible and substantially rectangular-shaped sheet-like roll covering member having a bottom surface engageable with such working surface of such printing plate cylinder and an axially opposed upper surface engageable with said bottom surface of said printing plate carrier sheet member and a pair of axially opposed outer edges provided. Such sheet-like roll covering member further having a predetermined length and a predetermined width and a predetermined thickness of generally between about twenty-five thousandths of an inch and about thirty-five thousandths of an inch, a narrow portion of the upper surface of such sheet-like roll covering member being engaged with at least a narrow portion of one of a bottom surface of one of such axially opposed surfaces of the first flat strip-like portion and a bottom surface of such printing plate carrier sheet member adjacent a first outer edge of a first of such pair of axially opposed outer edges of the sheet-like roll covering member. Such first outer edge of the first of such pair of axially opposed outer edges being located along the predetermined width of such sheet-like roll covering member and such at least a substantial portion of the first of such axially opposed surfaces of the first flat strip-like portion being located along the first predetermined length of such first flat strip-like portion. A securing means engageable with such sheet-like roll covering member and such printing plate carrier sheet member and such first flat strip-like portion is provided to secure such sheet-like roll covering member and such printing plate carrier sheet member to the first flat strip-like portion. This printing plate composite has a second flat strip-like portion with axially opposed surfaces and axially opposed outer edges. Such second flat strip-like portion further having a second predetermined length and a second predetermined width, which is less than the first predetermined width of such first flat strip-like portion, and a second predetermined thickness. An upper surface of such axially opposed surfaces of the second flat strip-like portion is positioned facing the bottom surface of such first flat strip-like portion and such bottom surface of the sheet-like roll covering member. The final essential element in this aspect of the invention is a connecting strip-like portion having axially opposed surfaces and axially opposed outer edges. Such connecting strip-like portion further having a third predetermined length and a third predetermined width and a third predetermined thickness. A first outer edge of such axially opposed outer edges of the connecting strip-like portion is connected along the third predetermined length thereof to a first outer edge of such axially opposed outer edges of the first flat strip-like portion along such first predetermined length thereof. A second outer edge of the axially opposed outer edges of such connecting strip-like portion is connected along the third predetermined length thereof to a first outer edge of such axially opposed outer edges of the second flat strip-like portion thereby forming a J-shaped hook-like member engageable in a groove-like portion adjacent such working surface of such printing plate cylinder.

OBJECTS OF THE INVENTION

It is, therefore, one of the primary objects of the present invention to provide a specially configured printing plate composite and securement apparatus which enables at least one printing plate carried on a carrier sheet to be relatively quickly aligned in a predetermined position on a working surface of a printing plate cylinder.

Another object of the present invention is to provide a specially configured printing plate composite and securement apparatus which enables rapid securement of one end of a printing plate carrier sheet to at least a portion of such roll covering disposed on a working surface of a printing plate cylinder.

Still another object of the present invention is to provide a specially configured printing plate securement apparatus which can be formed as an integral single piece unit and thereafter have a flexible sheet-like roll covering member secured thereto.

Yet another object of the present invention is to provide a specially configured printing plate composite and securement apparatus which is relatively inexpensive to manufacture.

A further object of the present invention is to provide a specially configured printing plate composite and securement apparatus which is relatively simple to use.

An additional object of the present invention is to provide a specially configured printing plate composite and securement apparatus which reduces the down time of a printing arrangement when it becomes necessary to change printing plates thereby improving the productivity of such printing arrangement.

Still yet another object of the present invention is to provide a specially configured printing plate composite and securement apparatus which will assist in improving the quality of multi-color printing jobs.

Yet still another object of the present invention is to provide a specially configured printing plate composite and securement apparatus which will enable a significant reduction in rejected product thereby minimizing substrate requirements.

A still further object of the present invention is to provide a specially configured printing plate composite and securement apparatus which will exhibit a relatively long useful life.

It is another object of the present invention to provide a specially configured printing plate composite and securement apparatus which can be readily adapted to different printing arrangements.

Still an additional object of the present invention is to provide a specially configured printing plate composite and securement apparatus which will provide enhanced quality of print material on a substrate material.

Another object of the present invention is to provide a specially configured printing plate composite and securement apparatus which will tolerate slight imperfections in a working surface of a printing plate cylinder.

Yet still another object of the present invention is to provide a specially configured printing plate composite and securement apparatus which will reduce board crush during a printing operation.

A still further object of the present invention is to provide a single customer use printing plate composite which is easy to use and inexpensive to manufacture.

Even though a number of rather specific objects and advantages of the combination roll covering and specially configured printing plate securement apparatus have been set out in detail above, various other objects and advantages of the present invention will become more readily apparent to those persons who are skilled in the printing plate securement art from the following, more detailed description of such invention, particularly, when such description is taken in conjunction with the attached drawing figures and with the appended claims.

BRIEF DESCRIPTION OF THE VARIOUS EMBODIMENTS OF THE PRESENT INVENTION

Figure 1:
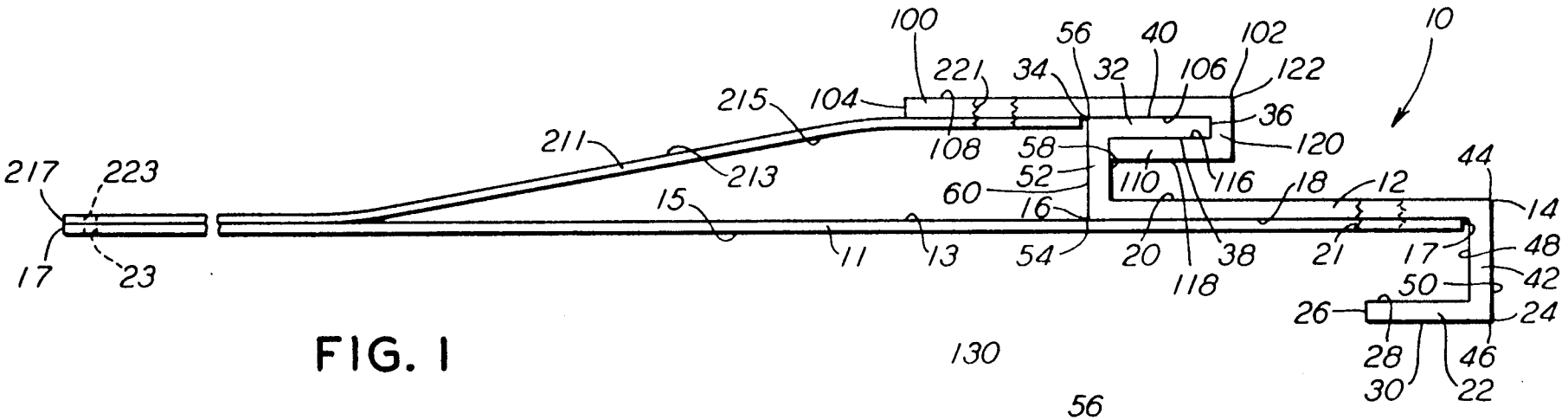
FIG. 1 is a side elevation view of a presently preferred embodiment of the specially configured printing plate composite and securement apparatus constructed according to the present invention.

Prior to proceeding to the more detailed description of the specially configured printing plate composite and securement apparatus, it should be noted that, in each of the drawing figures, identical components having identical functions have been identified, for the sake of clarity, with identical reference numerals.

Figure 3:
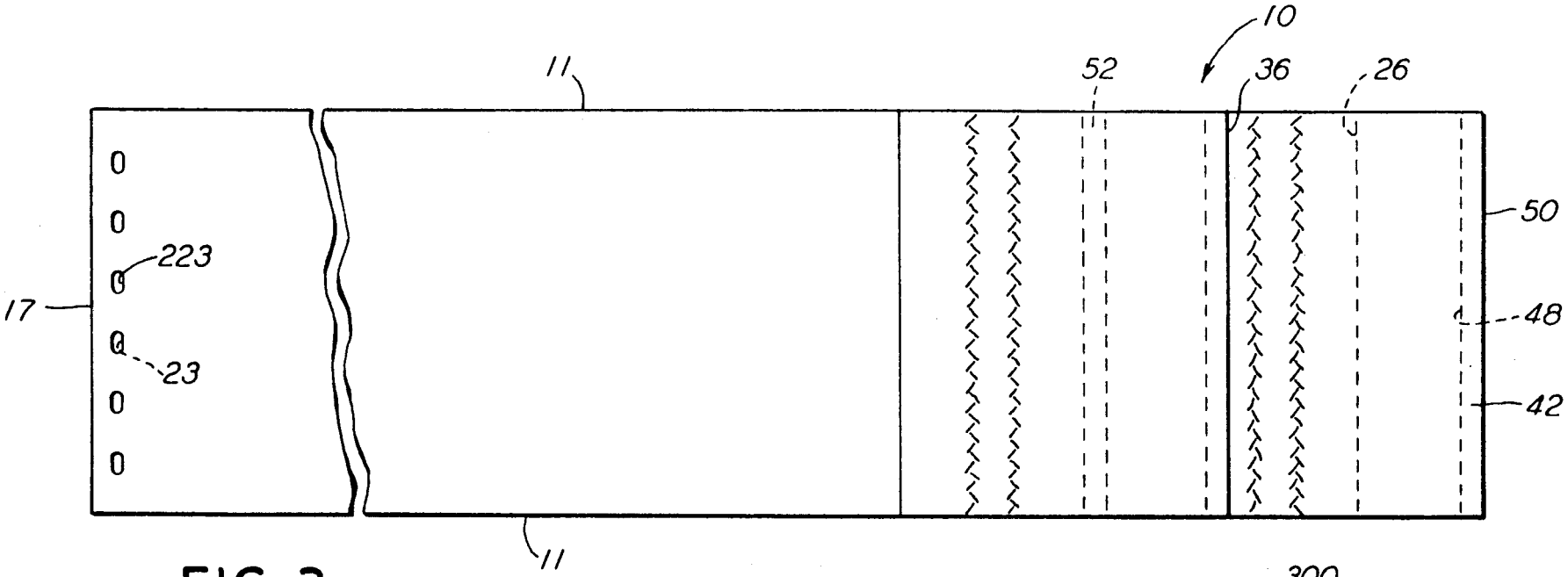
FIG. 3 is a plan view of a presently preferred embodiment of the specially configured printing plate securement composite and apparatus illustrated in FIG. 1.

Now refer, more particularly, to FIGS. 1 and 3. Illustrated therein is a specially configured printing plate composite and securement apparatus, generally designated 10, for use both in securing one end of a printing plate carrier sheet member 211 having at least one printing plate (not shown) disposed on an upper surface 213 thereof to at least a predetermined portion of a working surface (not shown) of at least one printing plate cylinder (not shown) disposed in at least one print station (not shown) of a printing arrangement (not shown) and in achieving a relatively quick alignment of such printing plate in a predetermined position on the working surface of such printing plate cylinder. Such printing plate having predetermined indicia disposed on an upper surface thereof.

This specially configured printing plate composite and securement apparatus 10 comprises a first elongated and substantially flat strip-like portion 12 having each of axially opposed outer edges 14 and 16 and axially opposed surfaces 18 and 20. Such first flat strip-like portion 12 further having a first predetermined length and a first predetermined width and a first predetermined thickness.

Apparatus 10 further includes a generally flexible and substantially rectangular-shaped sheet-like roll covering member 11 having axially opposed surfaces 13 and 15 and a pair of axially opposed outer edges 17 and 19. Such sheet-like roll covering member further has a predetermined length and a predetermined width and a predetermined thickness. The predetermined thickness of such sheet-like roll covering member being generally between about twenty-five thousandths of an inch and about thirty-five thousandths of an inch. A narrow portion of an upper surface 13 of this sheet-like roll covering member 11 is engaged with at least a substantial portion of a first surface 18 of such axially opposed surfaces 18 and 20 of the first flat strip-like portion 12 adjacent a first outer edge of a first 17 of the pair of axially opposed edges 17 and 19. This first outer edge of such first 17 of the pair of axially opposed outer edges 17 and 19 being located along the predetermined width of such sheet-like roll covering member 11 and the at least a substantial portion of such first surface 18 of the axially opposed surfaces 18 and 20 of such first sheet-like portion 12 being located along the first predetermined length of such first flat sheet-like portion 12. Such substantial portion of such first surface 18 of such axially opposed surfaces 18 and 20 of the first flat strip-like portion 12 being at least greater than fifty percent.

A securing means, such as stitching 21 or an adhesive (not shown), is engageable with both the first flat strip-like portion 12 and such sheet-like roll covering member 11 for securing this sheet-like roll covering member 11 to the first surface 18 of the axially opposed surfaces 18 and 20 of such first flat strip-like portion 12.

There is a second elongated and substantially flat strip-like portion 22 which has each of axially opposed outer edges 24 and 26 as well as axially opposed surfaces 28 and 30. Such second flat strip-like portion 22 further having a second predetermined length and a second predetermined width, which is less than such first predetermined width of the first flat strip-like portion 12, and a second predetermined thickness. A first surface 28 of such axially opposed surfaces 2 and 30 of such second flat strip-like portion 22 is positioned facing the first surface 18 of such axially opposed surfaces 18 and 20 of the first flat strip-like portion 12. In the presently preferred embodiment of the invention, such first surface 28 of the axially opposed surfaces 28 and 30 of such second flat strip-like portion 22 will be substantially parallel to such first surface 18 of such axially opposed surfaces 18 and 20 of the first flat strip-like portion 12.

Apparatus 10, of the instant invention, further includes a third elongated and substantially flat strip-like portion 32 having each of axially opposed outer edges 34 and 36 and axially opposed surfaces 38 and 40. Such third flat strip-like portion 32 further having a third predetermined length and a third predetermined width, which is also less than such first predetermined width of the first flat strip-like portion 12, and a third predetermined thickness. A first surface 38 of such axially opposed surfaces 38 and 40 of the third flat strip-like portion 32 is positioned such that it faces a second surface 20 of such axially opposed surfaces 18 and 20 of the first flat strip-like portion 12. Likewise, in the presently preferred embodiment of the invention, the first surface 38 of such axially opposed surfaces 38 and 40 of the third flat strip-like portion 32 will be substantially parallel to the second surface 20 of such axially opposed surfaces 18 and 20 of the first flat strip-like portion 12.

Another essential element of the securement apparatus 10 is a first elongated connecting strip-like portion 42 having axially opposed outer edges 44 and 46 and axially opposed surfaces 48 and 50. Such first connecting strip-like portion 42 further having a fourth predetermined length and a fourth predetermined width and a fourth predetermined thickness. A first outer edge 44 of such axially opposed outer edges 44 and 46 of the first connecting strip-like portion 42 being connected to a first outer edge 14 of such axially opposed outer edges 14 and 16 of the first flat strip-like portion 12 along the first predetermined length of such first flat strip-like portion 12 and such fourth predetermined length of such first connecting strip-like portion 42. The second outer edge 46 of such axially opposed outer edges 44 and 46 of the first connecting strip-like portion 42 is connected along the fourth predetermined length thereof to the first outer edge 24 of such axially opposed outer edges 24 and 26 of the second elongated flat strip-like portion 22 along the second predetermined length thereof. The second outer edge 26 of such axially opposed outer edges 24 and 26 of the second flat strip-like portion 22 being engageable in a groove-like portion (not shown) formed adjacent the working surface of such printing plate cylinder. Such groove-like portion extending substantially parallel to a longitudinal axis of such printing plate cylinder.

Another essential element of the apparatus 10 is a second elongated connecting strip-like portion 52 having axially opposed outer edges 54 and 56 and axially opposed surfaces 58 and 60. Such second connecting strip-like portion 52 further having a fifth predetermined length and a fifth predetermined width, which is equal to or less than such fourth predetermined width of such first connecting strip-like portion 42, and a fifth predetermined thickness. The first outer edge 54 of such axially opposed edges 54 and 56 of the second connecting strip-like portion 52 being connected to a second outer edge 16 of the axially opposed outer edges 14 and 16 of such first flat strip-like portion 12 along the first predetermined length of the first flat strip-like portion 12 and the fifth predetermined length of such second connecting strip-like portion 52. A second outer edge 56 of such axially opposed outer edges 54 and 56 of the second connecting strip-like portion 52 is connected along the fifth predetermined length thereof to a first outer edge 34 of the axially opposed outer edges 34 and 36 of such third flat strip-like portion 32 along the third predetermined length thereof, thereby forming a presently preferred embodiment of the specially configured S-shaped printing plate securement apparatus 10 having a sheet-like roll covering member 11 secured thereto.

Apparatus 10 also includes a fourth elongated and substantially flat strip-like portion 100 having each of axially opposed outer edges 102 and 104 and axially opposed surfaces 106 and 108. This fourth flat strip-like portion 100 further having a sixth predetermined length and a sixth predetermined width and a sixth predetermined thickness. Also provided is a fifth elongated and substantially flat strip-like portion 110 having each of axially opposed outer edges 112 and 114 and axially opposed surfaces 116 and 118. Such fifth flat strip-like portion also having a seventh predetermined length and a seventh predetermined width and a seventh predetermined thickness. The seventh predetermined width of the fifth flat strip-like portion 110 being less than the sixth predetermined width of such fourth flat strip-like portion 110. A first of such axially opposed surfaces 116 and 118 of the fifth flat strip-like portion 110 faces a first of such axially opposed surfaces 106 and 108 of such fourth flat strip-like portion 100.

There is a third elongated connecting strip-like portion 120 which has axially opposed outer edges 122 and 124 and axially opposed surfaces 126 and 128. Such third connecting strip-like portion 120 further has an eighth predetermined length and an eighth predetermined width and an eighth predetermined thickness. A first outer edge 122 of such axially opposed outer edges 122 and 124 of this third connecting strip-like portion 120 is connected to a first outer edge 102 of such fourth flat strip-like portion 100 along the sixth predetermined length thereof and the eighth predetermined length of such third connecting strip-like portion 120. A second outer edge 124 of such axially opposed outer edges 122 and 124 of this third connecting strip-like portion 120 is connected to a first outer edge 112 of such axially opposed outer edges 112 and 114 of the fifth flat strip-like portion 110 along the seventh predetermined length thereof and the eighth predetermined length of such third connecting strip-like portion 120 Formed thereby is a J-shaped hook-like member, generally designated 130, which, during operation, will be engaged with such S-shaped member. The printing plate composite and securement apparatus 10 also has a generally flexible and generally rectangular-shaped printing plate carrier sheet member 211 having a bottom surface 215 which, during use, faces an upper surface 13 of such sheet-like roll covering member 11 and an upper surface 213 which carries such printing plate thereon. Such printing plate carrier sheet member 211 has a pair of axially opposed outer edges 217 and 219 as well as a predetermined length, a predetermined width and a predetermined thickness. In this embodiment of the invention, the predetermined thickness of such printing plate carrier sheet member 211 will generally be between about twenty-five thousandths of an inch and about thirty-five thousandths of an inch. A portion of at least one of a upper surface 213 and a bottom surface 215 of the printing plate carrier sheet member 211 is engaged with at least a portion of one of the axially opposed surfaces 106 and 108 of the fourth flat strip-like portion 100 adjacent a first outer edge 217 of a first of such pair of axially opposed outer edges 217 and 219 of the printing plate carrier sheet member 211. The first outer edge of the first of such pair of axially opposed outer edges 217 and 219 of the printing plate carrier sheet member 211 is located along the predetermined width of the printing plate carrier sheet member 211 and such at least a portion of the one of such axially opposed surfaces 106 and 108 of the fourth flat strip-like portion 100 is located along the sixth predetermined length of the fourth flat strip-like portion 100.

The final essential element of the printing plate composite and securement apparatus 10 is a second securing means 221 which is engageable with each of the fourth flat strip-like portion 100 and the printing plate carrier sheet member 211 for securing such printing plate carrier sheet member 211 to such fourth flat strip-like portion 100.

According to the presently preferred embodiment of the invention, the predetermined thickness of such sheet-like roll covering member 11 will generally be between about twenty-five thousandths of an inch and about thirty-five thousandths of an inch. The most preferred thickness of such sheet-like roll covering member 11 is generally between about twenty-nine thousandths of an inch and about thirty-one thousandths of an inch. The combined thickness of such predetermined thickness of the sheet-like roll covering member 11 and the predetermined thickness of the printing plate carrier sheet member 211 will generally be about sixty thousandths of an inch. In this embodiment, the predetermined width of such sheet-like roll covering member 11 will be substantially identical to the first predetermined length of such first flat strip-like portion 12 and the predetermined length of such sheet-like roll covering member will generally be less than a length dimension of a circumference of such working surface of the printing plate cylinder. It is presently preferred that such sheet-like roll covering member 11 will be manufactured from one of plastic and a fabric material. However, the most preferred material being a plastic, commonly known in the industry as mylar. As best seen in FIG. 3, such sheet-like roll covering member 11 will preferably include a plurality of apertures 23 formed therethrough. Such apertures 23 are disposed adjacent a second outer edge of such first 17 of the pair of axially opposed outer edges 17 and 19 of the sheet-like roll covering member 11. Each of such plurality of apertures 23 formed through the sheet-like roll covering member 11 is adapted to be engageable by a strap-like member (not shown) used to attach a second axially opposed end of such sheet-like roll covering member 11 to the working surface of the printing plate cylinder. It being understood, however, that means (not shown) other than straps can be used to attach such second axially opposed end of such sheet-like roll covering member 11 to the working surface of the printing plate cylinder.

According to the presently preferred embodiment of the invention, such printing plate carrier sheet member 211 will be manufactured from a vinyl-like material. In one form of the invention, such printing plate carrier sheet member 211 will be secured to the bottom surface 106 of such fourth flat strip-like portion 100 and, in a preferred form of the invention, such printing plate carrier sheet member will be secured to an upper surface of such fourth flat strip-like portion 100. It should also be noted that, in a presently preferred embodiment, the predetermined width of such third connecting strip-like portion 120 will be at least equal to the predetermined thickness of such printing plate carrier sheet member 211 and the third predetermined thickness of such third flat strip-like portion 32. When the printing plate carrier sheet member 211 is secured to the bottom surface 106 of such fourth flat strip-like portion 100. On the other hand, such predetermined width of the third connecting strip-like portion 120 will be substantially equal to the third predetermined thickness of such third flat strip-like portion 32 when such printing plate carrier sheet member 211 is secured to the upper surface 108 of such fourth flat strip-like portion 100.

As seen in FIG. 1, the securing means 21 will preferably be one of stitching or an adhesive-type material with the most preferred securing means being stitching. Also, as best seen in FIG. 1, that narrow portion of the upper surface 13 of such sheet-like roll covering member 11 is engaged with substantially the entire surface area of such first surface 18 of such axially opposed surfaces 18 and 20 of the first flat strip-like portion 12.

In the presently preferred embodiment of the invention, each of such first predetermined length of the first flat strip-like portion 12 and the second predetermined length of such second flat strip-like portion 22 and the third predetermined length of such third flat strip-like portion 32 as well as the fourth predetermined length of such first connecting strip-like portion 42 and such fifth predetermined length of such second connecting strip-like portion 52 will all be substantially identical. In the same manner, the second securing means will be one of stitching and an adhesive for securing the printing plate carrier sheet member 211 to such fourth flat strip-like portion 100 with the most preferred form of securing means being stitching 221.

According to the presently preferred embodiment of the invention, such printing plate carrier sheet member 211 will include a plurality of apertures 223 formed therethrough adjacent a second outer edge of such first of such pair of axially opposed outer edges 217 of the printing plate carrier sheet member 211 to enable securing such printing plate carrier sheet member 211 to such printing plate cylinder.

In this embodiment, it is also preferred that the second predetermined width of such second flat strip-like portion 22 and such third predetermined width of the third flat strip-like portion 32 will generally be less than one-half the first predetermined width of such first flat strip-like portion 12.

Likewise, in the preferred embodiment of the invention, the fourth predetermined width of such first connecting strip-like portion 42 will be greater than the fifth predetermined width of such second connecting strip-like portion 52. Furthermore, this fourth predetermined width of such first connecting strip-like portion 42 will be at least sufficient to provide a spacing between such first surface 28 of the axially opposed surfaces 28 and 30 of such second flat strip-like portion 22 and the first surface 18 of the axially opposed surfaces 18 and 20 of the first flat strip-like portion 12 of at least about thirty-thousandths of an inch. In the most preferred embodiment, such fourth predetermined width of the first connecting strip-like portion 42 will provide a spacing between such first surface 28 of the axially opposed surfaces 28 and 30 of such second flat strip-like portion 22 and such first surface 18 of the axially opposed surfaces 18 and 20 of such first flat strip-like portion 12 of between about thirty-thousandths of an inch and about eighty-thousandths of an inch. It should be noted that the spacing between the first surface 38 of the axially opposed surfaces 38 and 40 of the third strip-like portion 32 and such second surface 20 of the axially opposed surfaces 18 and 20 of the first strip-like portion 12 will be less than such spacing between the first surface 28 of the axially opposed surfaces 28 and 30 of such second flat strip-like portion 22 and such first surface 18 of such axially opposed surfaces 18 and 20 of such first flat strip-like portion 12.

Although the present invention is not limited thereto, as will be seen from FIG. 2 which will be discussed hereinafter, it is preferred that such first flat strip-like portion 12 will be formed as a single piece. This is the case because it is preferred that the first strip-like portion 12 and the second strip-like portion 22 and the third strip-like portion 32 as well as the first connecting strip-like portion 42 and the second connecting strip-like portion 52 be formed as an integral single piece unit. The forming of such integral single piece unit is preferably accomplished by an extrusion process. Both plastic and metal extrusion processes are generally well known in the plastic and metal working art. For the sake of economy, the most preferred extrusion process being a plastic extrusion.

In the preferred embodiment of the invention, the spacing formed by surface 28 of the axially opposed surfaces 28 and 30 of such second flat strip-like portion 22 and the surface 18 of the axially opposed surfaces 18 and 20 of such first flat strip-like portion 12 will be substantially uniform across both a width dimension thereof and along a length dimension thereof. It is also presently preferred that the spacing formed by surface 38 of the axially opposed surfaces 38 and 40 of such third flat strip-like portion 3 and the surface 20 of such axially opposed surfaces 18 and 20 of the first flat strip-like portion 12 will also be substantially uniform across a width dimension thereof and along a length dimension thereof.

Such first predetermined thickness of the first flat strip-like portion 12 and such second predetermined thickness of the second flat strip-like portion 22 and the third predetermined thickness of such third flat strip-like portion 32 will be substantially identical in the presently preferred embodiment of the invention.

Further, such fourth predetermined thickness of the first connecting strip-like portion 42 will be substantially identical to such fifth predetermined thickness of the second connecting strip-like portion 52 in this embodiment of the invention.

In the most preferred embodiment of the invention, the predetermined thickness of each of the first flat strip-like portion 12 and the second flat strip-like portion 22 and the third flat strip-like portion 32 and the first connecting strip-like portion 42 and the second connecting strip-like portion 52 will all be substantially identical.

It is also preferred that the predetermined length of each of such first flat strip-like portion 12 and the second flat strip-like portion 22 and the third flat strip-like portion 32 and the first connecting strip-like portion 42 and the second connecting strip-like portion 52 will be at least slightly less than a length of such groove-like portion formed adjacent such working surface of such printing plate cylinder.

Figure 2:
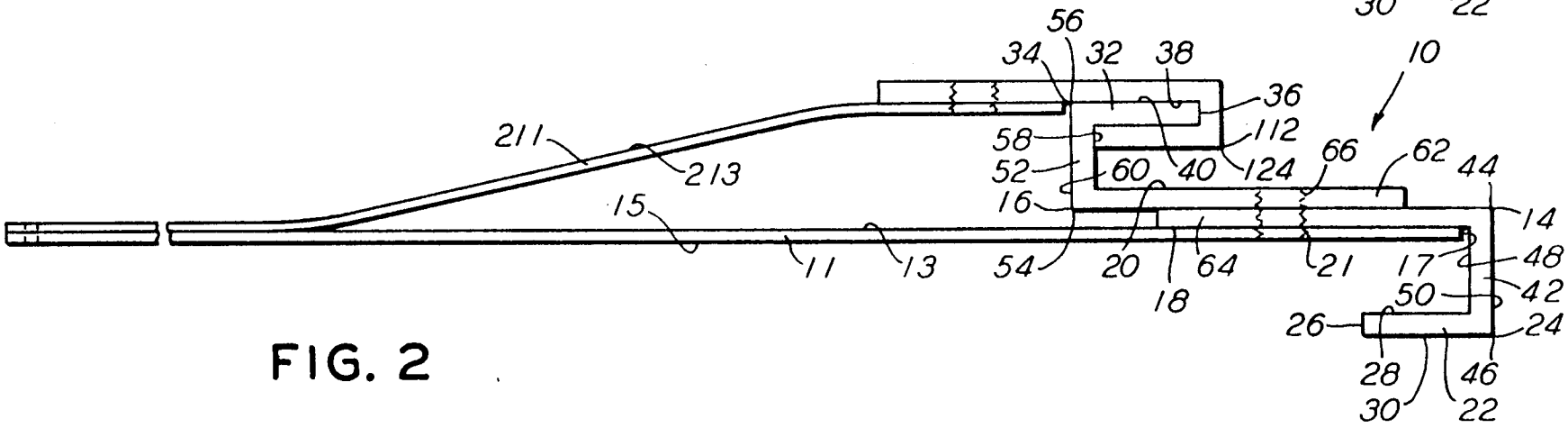
FIG. 2 is as side elevation view of an alternative embodiment of the specially configured printing plate composite and securement apparatus illustrated in FIG. 1.

As shown in FIG. 2, the equivalent of the first flat strip-like portion 12 illustrated in FIG. 1 can be formed in two pieces 62 and 64. In this case at least a portion of the elements 62 and 64 must overlap and be secured together in some manner. Such securing of pieces 62 and 64 together may be accomplished by stitching 66 or an adhesive (not shown). In this case, stitching 66 is the preferred means of securing pieces 62 and 64 together to form such first flat strip-like portion 12.

In operation, a bar-like member (not shown) disposed adjacent one edge of the groove-like portion located adjacent the working surface of the printing plate cylinder will be disposed in the spacing formed by surface 28 of the axially opposed surfaces 28 and 30 of such second flat strip-like portion 22, surface 48 of the axially opposed surfaces 48 and 50 of such first connecting strip-like portion and surface 18 of the axially opposed surfaces 18 and 20 of such first strip-like portion. Further, a printing plate (not shown) carried on a sheet-like material (not shown) having a securement apparatus (not shown) attached to a leading edge thereof will be connected to such printing plate cylinder by engagement of such securement apparatus within the spacing formed by surface 38 of such axially opposed surfaces 38 and 40 of such third flat strip-like portion 32, surface 58 of such axially opposed surfaces 58 and 60 of the second connecting strip-like portion 52 and surface 20 of such axially opposed surfaces 18 and 2 of the first flat strip-like portion 12.

In the most preferred embodiment of the invention, the predetermined thickness of such sheet-like roll covering member 11 will be substantially identical to the predetermined thickness of such printing plate carrier sheet member 211.

Although the combination roll covering and specially configured printing plate securement apparatus 10, of the present invention, is not limited thereto, it is particularly useful in a printing arrangement having a plurality of print stations. Such plurality of print stations being required for printing multi-color prints. In addition, this invention is particularly well suited for use in a flexographic printing arrangement for printing on corrugated board used in packaging for products sold to consumers in retail outlets.

Figure 4:
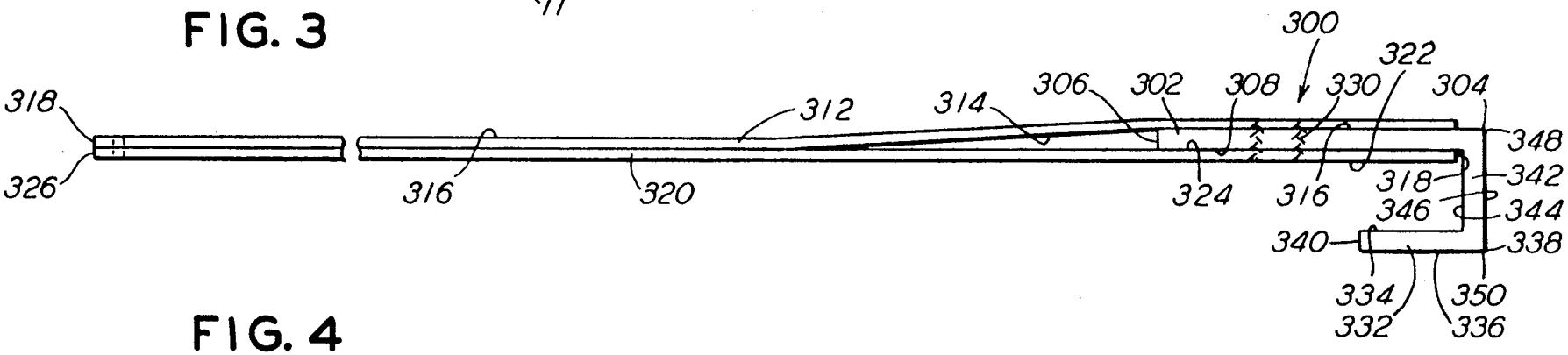
FIG. 4 is a side view of a presently preferred single customer use printing plate composite including a securement apparatus.

Now refer, more particularly, to FIG. 4. Illustrated therein is a specially configured printing plate composite, generally designated 300, which is designed for a single use. Such printing plate composite 300 enables a printing plate to be both quickly secured to and accurately aligned on a predetermined portion of a working surface of a printing plate cylinder. Such printing plate cylinder being disposed in at least one print station of a printing arrangement. This specially configured printing plate composite 300 includes a first elongated and substantially strip-like portion 302 having each of axially opposed outer edges 304 and 306 and axially opposed surfaces 308 and 310. Such first flat strip-like portion 302 further having a first predetermined width and a first predetermined thickness.

Printing plate composite 300 further includes a generally flexible and generally rectangular-shaped printing plate carrier sheet member 312 having a bottom surface 314 and an upper surface 316 which carries such printing plate thereon. Printing plate carrier sheet member 312 further has a pair of axially opposed outer edges 318 and 320 in addition to a predetermined length and a predetermined width and a predetermined thickness generally between about twenty-five thousandths of an inch and about thirty-five thousandths of an inch. A portion of at least one of the bottom surface 314 and the top surface 316 of such printing plate carrier sheet member 312 is engaged with at least a portion of one of the upper surface 310 and bottom surface 308 respectively, of such axially opposed surfaces 308 and 310 of the first flat sheet-like portion 302 adjacent a first outer edge of a first of such pair of axially opposed outer edges 318 and 320 of the printing plate carrier sheet member 312. Such first outer edge 318 of such first of such pair of axially opposed outer edges 318 and 320 of the printing plate carrier sheet member 312 being located along the predetermined width of such printing plate carrier sheet member 312 and such at least a portion of the upper surface 310 of such axially opposed surfaces 308 and 310 of the first flat strip-like portion 302 being located along the first predetermined length of the first flat strip-like portion 302.

Another element of the printing plate composite 300 is a generally flexible and substantially rectangular-shaped sheet-like roll covering member 320. Sheet-like roll covering member 320 has a bottom surface 322 which is engageable with the working surface of such printing plate cylinder and an axially opposed upper surface 324 and a pair of axially opposed outer edges 326 and 328. Such sheet-like roll covering member 320 further having a predetermined length and a predetermined width and a predetermined thickness. The predetermined thickness of such sheet-like roll covering member 320 will generally be between about twenty-five thousandths of an inch and about thirty-five thousandths of an inch. A portion of the upper surface 324 of such sheet-like roll covering member 320 will be engaged with at least a portion of one of a bottom surface 308 of the axially opposed surfaces 308 and 310 of such first flat strip-like portion 302 and such printing plate carrier sheet member 320 adjacent a first outer edge of a first of such pair of axially opposed outer edges of the sheet-like roll covering member 320. Such first outer edge of such first of such axially opposed outer edges 326 and 328 being located along the predetermined width of such sheet-like roll covering member 320 and such at least a portion of the first of such axially opposed surfaces 308 and 310 of such first flat strip-like portion 302 is located along the first predetermined length of such first flat strip-like portion 302.

A securing means 330 engageable with such sheet-like roll covering member 320 and such printing plate carrier sheet member 312 and the first flat strip-like portion 302 is provided to secure such sheet-like roll covering member 320 and such printing plate carrier member 312 to the first flat strip-like portion 302. The printing plate composite 300 also has a second flat strip-like portion 332 having axially opposed surfaces 334 and 336 and axially opposed outer edges 338 and 340. This second flat strip-like portion 332 further includes a second predetermined length and a second predetermined width, which is less than such first predetermined width and a second predetermined thickness. An upper surface 334 of the axially opposed surfaces 334 and 336 of the second flat strip-like portion 332 faces the bottom surface 308 of such first flat strip-like portion 302 and the bottom surface 322 of such sheet-like roll covering member 320.

The final essential element of this printing plate composite 100 is a connecting strip-like portion 342 having axially opposed surfaces 344 and 346 and axially opposed outer edges 348 and 350. Such connecting strip-like portion 342 further having a third predetermined length and a third predetermined width and a third predetermined thickness. A first outer edge 348 of such connecting strip-like portion 342 is connected to a first outer edge 304 of such first flat strip-like portion 302 and a second outer edge 350 of this connecting strip-like portion 342 is connected to a first outer edge 338 of such second flat strip-like portion 332, thereby forming a J-shaped hook-like member engageable in a groove-like portion formed adjacent the working surface of the printing plate cylinder.

In one form of the present invention, the portion of such bottom surface 314 of the printing plate carrier sheet member 312 is engaged with such at least a portion of the upper surface 310 of such axially opposed surfaces 308 and 310 of such first flat strip-like portion 302. In this embodiment, such portion of the upper surface 324 of such sheet-like roll covering member 320 is engaged with such portion of the bottom surface 308 of such axially opposed surfaces 308 and 310 of the first flat strip-like portion 302.

While a number of presently preferred and alternative embodiments of the combination roll covering and specially configured printing plate securement apparatus have been described in considerable detail above, it should be understood that various other modifications and adaptations of the present invention can be envisioned and made by those persons who are skilled in the printing plate securing art without departing from the spirit and scope of the appended claims.

I claim:

1. A specially configured printing plate composite and securement apparatus for use both in securing one end of a carrier sheet having at least one printing plate disposed on an upper surface thereof to at least a predetermined portion of a working surface of at least one printing plate cylinder disposed in at least one print station of a printing arrangement and in achieving a relatively rapid alignment of said composite, including such printing plate, in a predetermined position on such working surface of such printing plate cylinder, said specially configured printing plate composite and securement apparatus comprising:

(a) a first elongated and substantially flat strip-like portion having each of axially opposed outer edges and axially opposed surfaces, said first flat strip-like portion further having a first predetermined length and a first predetermined width and a first predetermined thickness;

(b) a generally flexible and substantially rectangular-shaped sheet-like roll covering member having axially opposed surfaces and a pair of axially opposed outer edges, said sheet-like roll covering member further having a predetermined length and a predetermined width and a predetermined thickness, said predetermined thickness of said sheet-like roll covering member being generally between about twenty-five thousandths of an inch and about thirty-five thousandths of an inch, a narrow portion of an upper surface of said sheet-like roll covering member being engaged with at least a substantial portion of a first of said axially opposed surfaces of said first flat strip-like portion adjacent a first outer edge of a first of said pair of axially opposed outer edges, said first outer edge of said first of said pair of axially opposed outer edges being located along said predetermined width of said sheet-like roll covering member and said at least a substantial portion of said first of said axially opposed surfaces of said first flat strip-like portion being located along said first predetermined length of said first flat strip-like portion;

(c) a first securing means engageable with said first flat strip-like portion and said sheet-like roll covering member for securing said narrow portion of said sheet-like roll covering member to said substantial portion of said first flat strip-like portion;

(d) a second elongated and substantially flat strip-like portion having each of axially opposed outer edges and axially opposed surfaces, said second flat strip-like portion further having a second predetermined length and a second predetermined width, which is less than said first predetermined width of said first flat strip-like portion, and a second predetermined thickness, a first surface of said axially opposed surfaces of said second flat strip-like portion facing a first surface of said axially opposed surfaces of said first flat strip-like portion and a bottom surface of such sheet-like roll covering member;

(e) a third elongated and substantially flat strip-like portion having each of axially opposed outer edges and axially opposed surfaces, said third flat strip-like portion further having a third predetermined length and a third predetermined width, which is less than said first predetermined width of said first flat strip-like portion, and a third predetermined thickness, a first surface of said axially opposed surfaces of said third flat strip-like portion facing a second surface of said axially opposed surfaces of said first flat strip-like portion;

(f) a first elongated connecting strip-like portion having axially opposed outer edges and axially opposed surfaces, said first connecting strip-like portion further having a fourth predetermined length and a fourth predetermined width and a fourth predetermined thickness, a first outer edge of said axially opposed outer edges of said first connecting strip-like portion being connected to a first outer edge of said axially opposed outer edges of said first flat strip-like portion along said first predetermined length of said first flat strip-like portion and said fourth predetermined length of said first connecting strip-like portion and a second outer edge of said axially opposed outer edges of said first connecting strip-like portion being connected to a first outer edge of said axially opposed outer edges of said second flat strip-like portion along said second predetermined length of said second flat strip-like portion and said fourth predetermined length of said first connecting strip-like portion, a second outer edge of said axially opposed outer edges of said second flat strip-like portion being engageable in a groove-like portion formed adjacent such working surface of such printing plate cylinder and substantially parallel to a longitudinal axis thereof;

(g) a second elongated connecting strip-like portion having axially opposed outer edges and axially opposed surfaces, said second connecting strip-like portion further having a fifth predetermined length and a fifth predetermined width, which is equal to or less than said fourth predetermined width of said first connecting strip-like portion, and a fifth predetermined thickness, a first outer edge of said axially opposed outer edges of said second connecting strip-like portion being connected to a second outer edge of said axially opposed outer edges of said first flat strip-like portion along said first predetermined length of said first flat strip-like portion and said fifth predetermined length of said second connecting strip-like portion and a second outer edge of said axially opposed outer edges of said second connecting strip-like portion being connected to a first outer edge of said axially opposed outer edges of said third flat strip-like portion along said third predetermined length of said third flat strip-like portion and said fifth predetermined length of said second connecting strip-like portion thereby forming a specially configured S-shaped flexible roll covering and printing plate securement apparatus;

(h) a fourth elongated and substantially flat strip-like portion having each of axially opposed outer edges and axially opposed surfaces, said fourth flat strip-like portion further having a sixth predetermined length and a sixth predetermined width and a sixth predetermined thickness;

(i) a fifth elongated and substantially flat strip-like portion having each of axially opposed outer edges and axially opposed surfaces, said fifth flat strip-like portion further having a seventh predetermined length and a seventh predetermined width, which is less than said sixth predetermined width of said fourth flat strip-like portion, and a seventh predetermined thickness, a first surface of said axially opposed surfaces of said fifth flat strip-like portion facing a first surface of said axially opposed surfaces of said fourth flat strip-like portion;

(j) a third elongated connecting strip-like portion having axially opposed outer edges and axially opposed surfaces, said third connecting strip-like portion further having an eighth predetermined length and an eighth predetermined width and an eighth predetermined thickness, a first outer edge of said axially opposed outer edges of said third elongated connecting strip-like portion being connected to a first outer edge of said axially opposed outer edges of said fourth flat strip-like portion along said sixth predetermined length thereof and said eighth predetermined length of said third connecting strip-like portion, a second outer edge of said axially opposed outer edges of said third connecting strip-like portion being connected to a first outer edge of said axially opposed outer edges of said fifth flat strip-like portion along said seventh predetermined length thereof and said eighth predetermined length of said third connecting strip-like portion thereby forming a J-shaped hook-like member which, during operation, will be engaged with said S-shaped member;

(k) a generally flexible and generally rectangular-shaped printing plate carrier sheet member having a bottom surface which, during use, faces an upper surface of said sheet-like roll covering member and an upper surface which carries such printing plate thereon and a pair of axially opposed outer edges, said printing plate carrier sheet member further having a predetermined length and a predetermined width and a predetermined thickness, said predetermined thickness of said printing plate carrier sheet member being generally between about twenty-five thousandths of an inch and about thirty-five thousandths of an inch, a narrow portion of at least one of said upper surface and said bottom surface of said printing plate carrier sheet member being engaged with at least a substantial portion of one of said axially opposed surfaces of said fourth flat strip-like portion adjacent a first outer edge of a first of said pair of axially opposed outer edges of said printing plate carrier sheet member, said first outer edge of said first of said pair of axially opposed outer edges of said printing plate carrier sheet member being located along said predetermined width of said printing plate carrier sheet member and said at least a substantial portion of said one of said axially opposed surfaces of said fourth flat strip-like portion being located along said sixth predetermined length of said fourth flat strip-like portion; and (l) a second securing means engageable with said fourth flat strip-like portion and said printing plate carrier sheet member for securing said printing plate carrier sheet member to said fourth flat strip-like portion.

2. A specially configured printing plate composite and securement apparatus, according to claim wherein a combined thickness of said predetermined thickness of said sheet-like roll covering member and said predetermined thickness of said printing plate carrier sheet member will generally be about sixty-thousandths of an inch.

3. A specially configured printing plate composite and securement apparatus, according to claim 2, wherein said sheet-like roll covering member is plastic.

4. A specially configured printing plate composite and securement apparatus, according to claim 3, wherein said plastic is mylar.

5. A specially configured printing plate composite and securement apparatus, according to claim 4, wherein said printing plate carrier sheet member is vinyl.

6. A specially configured printing plate composite and securement apparatus, according to claim 2, wherein each of said first securing means and said second securing means is stitching.

7. A specially configured printing plate composite and securement apparatus, according to claim 2, wherein said predetermined thickness of said sheet-like roll covering member is substantially equal to said predetermined thickness of said printing plate carrier sheet member.

8. A specially configured printing plate composite and securement apparatus, according to claim wherein said printing plate carrier sheet member is secured to said bottom surface of said fourth flat strip-like portion.

9. A specially configured printing plate composite and securement apparatus, according to claim 8, wherein said predetermined width of said third connecting strip-like portion is at least equal to a combined thickness of said predetermined thickness of said printing plate carrier sheet member and said third predetermined thickness of said third flat strip-like portion.

10. A specially configured printing plate composite and securement apparatus, according to claim 1, wherein said printing plate carrier sheet member is secured to an upper surface of said fourth flat strip-like portion.

11. A specially configured printing plate composite and securement apparatus, according to claim 10, wherein said predetermined width of said third connecting strip-like portion is substantially equal to said third predetermined thickness of said third flat strip-like portion.

12. A specially configured printing plate composite and securement apparatus, according to claim 1, wherein said first securing means is one of stitching and an adhesive.

13. A specially configured printing plate composite and securement apparatus, according to claim 12, wherein said second securing means is one of stitching and an adhesive.

14. A specially configured printing plate composite and securement apparatus, according to claim 1, wherein said printing plate carrier sheet member further includes a plurality of apertures formed therethrough adjacent a second outer edge of said first of said pair of axially opposed outer edges of said printing plate carrier sheet member to enable securing such printing plate carrier sheet member to such printing plate cylinder.

15. A specially configured printing plate composite which can be both quickly secured to and accurately aligned on a predetermined portion of a working surface of a printing plate cylinder disposed in at least one print station of a printing arrangement, said specially configured printing plate composite comprising:

(a) a first elongated and substantially flat strip-like portion having each of axially opposed outer edges and axially opposed surfaces, said first flat strip-like portion further having a first predetermined length and a first predetermined width and a first predetermined thickness;

(b) a generally flexible and generally rectangular-shaped printing plate carrier sheet member having a bottom surface and an upper surface which carries such printing plate thereon, and a pair of axially opposed outer edges, said printing plate carrier sheet member further having a predetermined length and a predetermined width and a predetermined thickness of generally between about twenty-five thousandths of an inch and about thirty-five thousandths of an inch, a narrow portion of at least one of said bottom surface and said top surface of said printing plate carrier sheet member being engaged with at least a substantial portion of one of an upper surface and a bottom surface, respectively, of said axially opposed surfaces of said first flat stain-like portion adjacent a first outer edge of a first of said pair of axially opposed outer edges of said printing plate carrier sheet member, said first outer edge of said first of said pair of axially opposed outer edges of said printing plate carrier sheet member being located along said predetermined width of said printing plate carrier sheet member and said at least a substantial portion of said upper surface of said axially opposed surfaces of said first flat strip-like portion being located along said first predetermined length of said first flat strip-like portion;

(c) a generally flexible and substantially rectangular-shaped sheet-like roll covering member having a bottom surface engageable with such working surface of such printing plate cylinder and an axially opposed upper surface engageable with said bottom surface of said printing plate carrier sheet member and a pair of axially opposed outer edges, said sheet-like roll covering member further having a predetermined length and a predetermined width and a predetermined thickness of generally between about twenty-five thousandths of an inch and about thirty-five thousandths of an inch, a narrow portion of said upper surface of said sheet-like roll covering member being engaged with at least a portion of one of a bottom surface of one of said axially opposed surfaces of said first flat strip-like portion and said printing plate carrier sheet member adjacent a first outer edge of a first of said pair of axially opposed outer edges of said sheet-like roll covering member, said first outer edge of said first of said pair of axially opposed outer edges being located along said predetermined width of said sheet-like roll covering member and said at least a substantial portion of said first of said axially opposed surfaces of said first flat strip-like portion being located along said first predetermined length of said first flat strip-like portion;

(d) a securing means engageable with said sheet-like roll covering member and said printing plate carrier sheet member and said first flat strip-like portion for securing said sheet-like roll covering member and said printing plate carrier sheet member to said first flat strip-like portion;

(e) a second flat strip-like portion having axially opposed surfaces and axially opposed outer edges, said second flat strip-like portion further having a second predetermined length and a second predetermined width, which is less than said first predetermined width of said first flat strip-like portion, and a second predetermined thickness, an upper surface of said axially opposed surfaces of said second flat strip-like portion facing said bottom surface of said first flat strip-like portion and said bottom surface of said sheet-like roll covering member; and (f) a connecting strip-like portion having axially opposed surfaces and axially opposed outer edges, said connecting strip-like portion further having a third predetermined length and a third predetermined width and a third predetermined thickness, a first outer edge of said axially opposed outer edges of said connecting strip-like portion being connected along said third predetermined length thereof to a first outer edge of said axially opposed outer edges of said first flat strip-like portion along said first predetermined length thereof and a second outer edge of said axially opposed outer edges of said connecting strip-like portion being connected along said third predetermined length thereof to a first outer edge of said axially opposed outer edges of said second flat strip-like portion thereby forming a J-shaped hook-like member engageable in a groove-like portion adjacent such working surface of such printing plate cylinder.

16. A specially configured printing plate composite according to claim 15, wherein said narrow portion of said bottom surface of said printing plate carrier sheet member is engaged with said at least a substantial portion of said upper surface of said axially opposed surfaces of said first flat strip-like portion.

17. A specially configured printing plate composite according to claim 16, wherein said narrow portion of said upper surface of said sheet-like roll covering member is engaged with said substantial portion of said bottom surface of said axially opposed surfaces of said first flat strip-like portion.

18. A specially configured printing plate composite according to claim 15, wherein said securing means is one of stitching and an adhesive.

19. A specially configured printing plate composite according to claim 15, wherein said predetermined thickness of said sheet-like roll covering member plus said predetermined thickness of said printing plate carrier sheet member will generally be about sixty-thousandths of an inch.

20. A specially configured printing plate composite according to claim 15, wherein said predetermined width of said printing plate carrier sheet member is substantially equal to said predetermined width of said sheet-like roll covering member.

* * * * *

UNITED STATES PATENT AND TRADEMARK OFFICE

CERTIFICATE OF CORRECTION

PATENT NO. : 5,127, 327

DATED : July 7, 1992

INVENTOR(S) : Ivan N. Philpot

It is certified that error appears in the above-indentified patent and that said Letters Patent is hereby corrected as shown below:

Column 8, line 54, after member, insert --11--;

Column 8, line 57, after member, insert --11--.

Column 9, line 22, delete "2" and insert --28--.

Column 11, line 2, after 120, insert --.--;

Column 11, line 59, after member, insert --11--;

Column 13, line 58, delete "3", and insert --32--.

Column 14, line 48, delete "2" and insert --20--.

Column 19, line 43, after claim, insert --1,--;

Signed and Sealed this

Fourth Day of January, 1994

Bruce Lehman

*Attest:*

BRUCE LEHMAN

*Attesting Officer*

*Commissioner of Patents and Trademarks*